United States Patent [19]

Röck

[11] Patent Number: 4,952,074

[45] Date of Patent: Aug. 28, 1990

[54] PULL-OUT GUIDE FOR DRAWERS

[75] Inventor: Erich Röck, Höchst, Austria

[73] Assignee: Julius Blum Gesellschaft m.b.H., Höchst, Austria

[21] Appl. No.: 433,203

[22] Filed: Nov. 8, 1989

[30] Foreign Application Priority Data

Nov. 10, 1988 [AT] Austria ..... 2752/88

[51] Int. Cl.[5] ..... F16C 29/04

[52] U.S. Cl. ..... 384/19; 384/53

[58] Field of Search ..... 384/19, 18, 21, 22, 384/53; 312/350

[56] References Cited

U.S. PATENT DOCUMENTS 3,901,564 8/1975 Armstrong ..... 384/18
4,089,567 5/1978 Röck et al. ..... 384/19
4,601,522 7/1986 Röck ..... 384/19
4,659,237 4/1987 Rapp ..... 384/19

*Primary Examiner*—Lenard A. Footland
*Attorney, Agent, or Firm*—Wenderoth, Lind & Ponack

[57] ABSTRACT

A pull-out guide assembly for drawers comprising a pull-out rail fastened to the drawer, a supporting rail fastened to the body of the piece of furniture and a center rail differentially running between said two rails on each side of the drawer. Running carriages which hold load-transmitting running rollers are arranged between said rails. Driving rollers which run on the supporting rails and on the pull-out rails are mounted on the center rails. The center rails have Z-profiles, and the supporting rails and the pull-out rails have U-profiles which are substantially half-covered.

6 Claims, 4 Drawing Sheets

PULL-OUT GUIDE FOR DRAWERS

FIELD AND BACKGROUND OF THE INVENTION

The invention relates to a pull-out guide assembly for drawers comprising a pull-out rail fastened to the drawer, a supporting rail fastened to the body of the piece of furniture and a center rail differentially running between said two rails on each side of the drawer, running carriages holding load-transmitting cylindrical bodies being arranged between said rails, and driving rollers running on the supporting rails and on the pull-out rails being mounted on the center rails.

A pull-out guide assembly of the afore-mentioned kind allows substantially full extraction of the drawer from the body of the piece of furniture and hence guarantees optimal access to the contents of the drawer.

An example of such a drawer is described in U.S. Pat. No. 3,901,564. Steel balls which are held in cages are used as cylindrical bodies in the pull-out guide assembly described in the cited Patent. These steel balls require relatively complicated profiles the supporting rails and of the pull-out rails. Furthermore, no run-in means for the drawer is provided because of the rail profiles.

To be able to use simpler rail profiles in connection with the same loading capacity, ball bearings would have to be used instead of steel balls according to the known state of the art. Ball bearings cause, however, a considerable increase of costs.

SUMMARY OF THE INVENTION

It is the object of the invention to provide a pull-out guide assembly which guarantees smooth running of a drawer carrying heavier loads and allows the use of simple running rollers.

According to the invention this is achieved in that the center rails have Z-profiles, and the supporting rails and the pull-out rails have U-profiles which are substantially half-covered and upwardly or downwardly open.

In the embodiment according to the invention, the diversion of forces takes place directly via cylindrical bodies in the form of running rollers, each of said cylindrical bodies corresponding to the cylinder of a roller bearing. There is no load acting on the axles of the driving rollers, and there is no axle friction. Furthermore, only low pull-out forces are required.

It is advantageously provided that the driving rollers are received in the profile of the supporting rail.

An embodiment of the invention provides that the cylindrical bodies which are designed as running rollers have substantially half the diameter of the driving rollers.

It is further provided that the running rollers are arranged in the supporting rails and the driving rollers at opposite sides of the center rail.

One embodiment of the invention provides that in the inserted position of the drawer, two times two running rollers and one driving roller are arranged on a common vertical line on each side of the drawer.

BRIEF DESCRIPTION OF THE FIGURES OF THE DRAWING

In the following an embodiment of the invention will be described in more detail with reference to the figures of the drawing in which.

DESCRIPTION OF THE PREFERRED EMBODIMENT

The pull-out guide assembly according to the invention comprises on each side of the drawer the supporting rail 17 on the side of the body, the pull-out rail 18 on the side of the drawer and the center rail 19 running between said two rails 17, 18.

Figure 1:
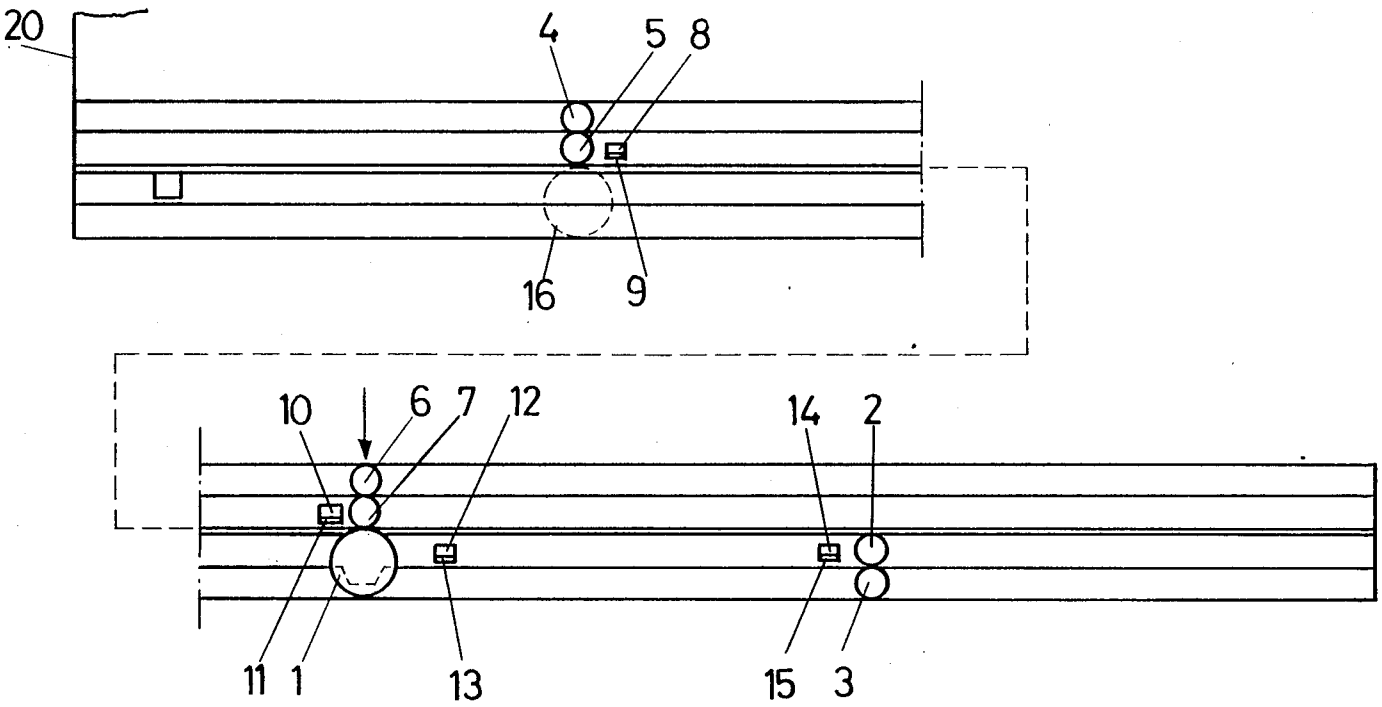
FIG. 1 shows a diagrammatic side view of a pull-out guide assembly, the drawer being in the inserted position.
Figure 2:
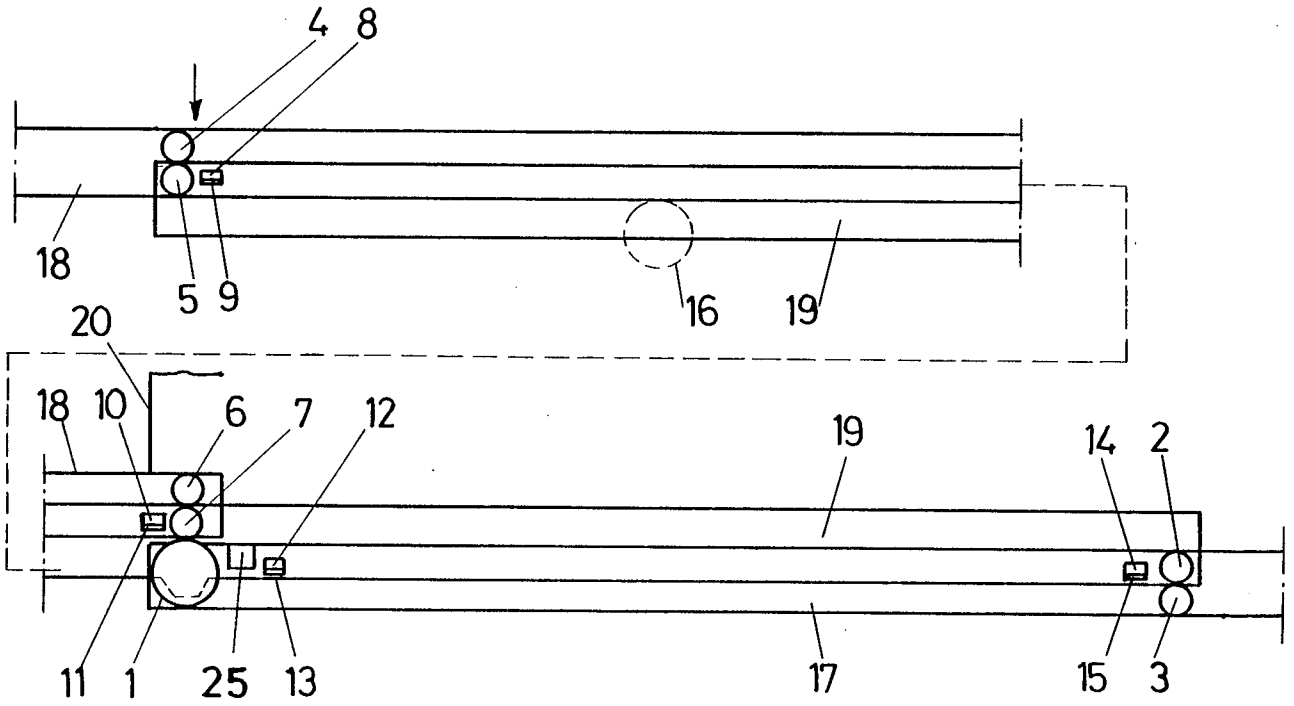
FIG. 2 shows a side view of the pull-out guide assembly according to the invention, the drawer being extracted from the body of the piece of furniture.

The pull-out guide assembly permits almost full extraction of the drawer, which is anchored in the guide means, from the body of the piece of furniture. Excessive extraction does not occur, however. In FIG. 2, the body front edge is designated with reference number 20. This figure also shows that the rear end of the pull-out rail 18 is in its extreme front position still in the region of the body of the piece of furniture.

Figure 3:
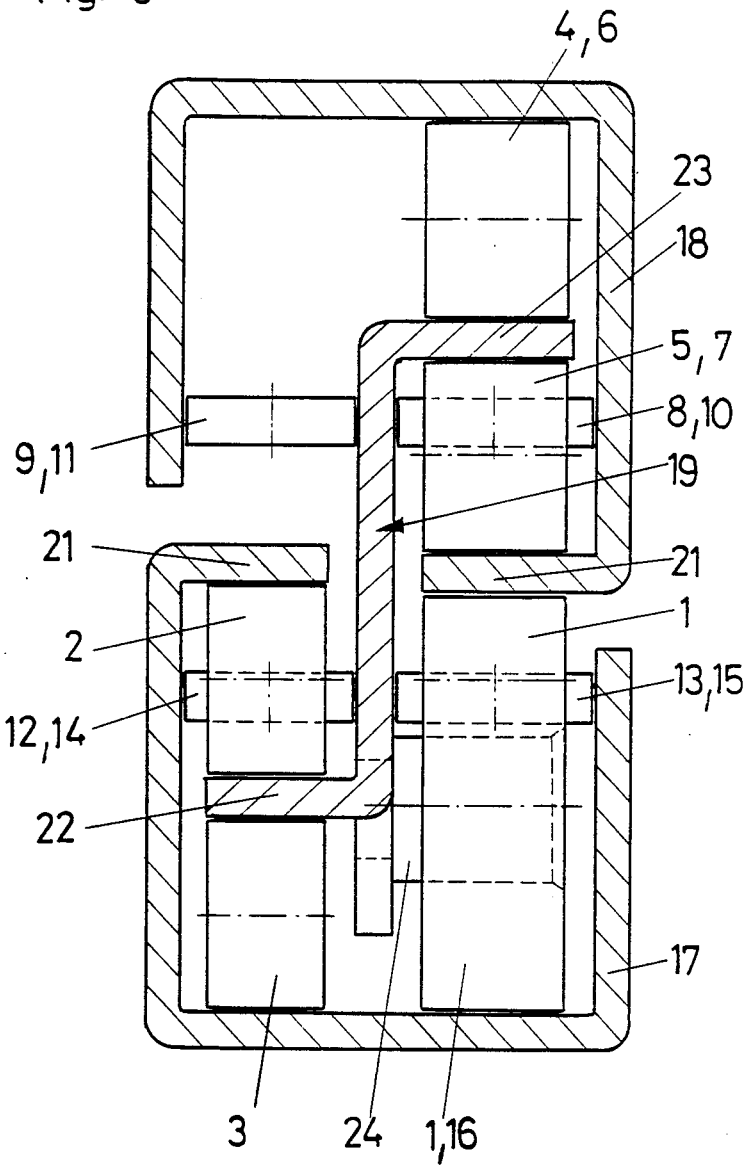
FIG. 3 shows a cross-sectional view of a pull-out guide assembly according to the invention on one side of the drawer.

As can be seen from FIG. 3, the supporting rail 17 and the pull-out rail 18 have identical U-profiles which are half-covered by flanges 21, the rails 17, 18 being turned in respect of each other by 180°.

The center rail has a Z-profile and projects in this arrangement with half of its profile into the pull-out rail 18 and into the supporting rail 17. The horizontal flanges 22, 23 of the center rail 19 form the running flanges for the running rollers 2,3,4,5,6 and 7. The running rollers 2–7 are held in cage-like running carriages which are not shown.

Two driving rollers 1 and 16 are mounted at the center rail 19 by means of axles 24. The driving rollers 1, 16 run directly between the supporting rail 17 and the pull-out rail 18 (flanges 21), and there acts no load upon axle 24.

The driving roller 16 is mounted on the center rail 19 advantageously with clearance and prevents a tilting clearance of the drawer, when the latter-mentioned is in the inserted position.

Laterally acting compensating rollers 8,9,10,11,12,13,14, 15 which guarantee the lateral stability of the drawer are mounted in the running carriages.

Means 25 preventing lifting of the center rail 19 are provided at the front end of the supporting rail 17.

The driving rollers 1, 16 as well as the running rollers 2–7 are advantageously made of plastics material. Hence the supporting rail 17, the pull-out rail 18 and the center rail 19 can be plastic-coated without causing damage to the coating when the drawer is in use.

Figure 4:
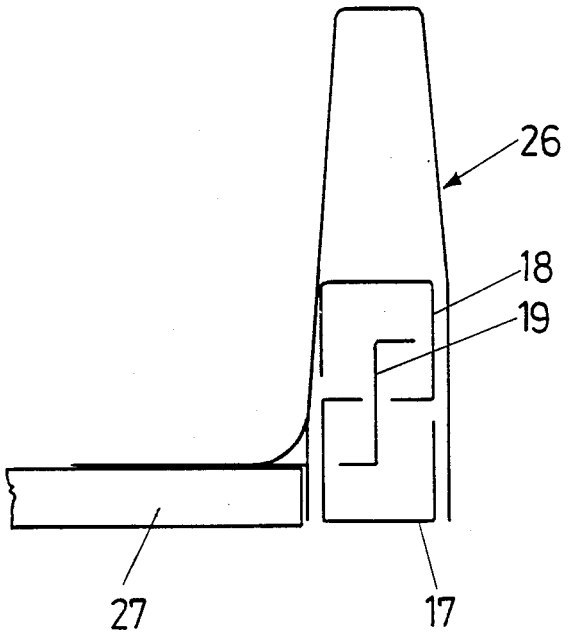
FIG. 4 shows a mounting arrangement of the pull-out guide assembly according to the invention.

As can be seen from FIG. 4, the pull-out guide assembly according to the invention may advantageously be mounted in a drawer with double side walls 26. In FIG. 4, the drawer bottom is designated with reference number 27.

What is claimed is:

1. A pull-out guide assembly for drawers comprising a pull-out rail fastened to the drawer, a supporting rail fastened to the body of the piece of furniture and a center rail differentially running between said two rails on each side of the drawer, running carriages holding load-transmitting cylindrical bodies being arranged between said rails, and driving rollers running on the supporting rails and on the pull-out rails being mounted on the center rails, wherein said center rails have Z-profiles and said supporting rails and said pull-out rails have U-profiles which are substantially half-covered and upwardly and downwardly open.

2. A pull-out guide assembly as claimed in claim 1, wherein said driving rollers are received in the profile of said supporting rail.

3. A pull-out guide assembly as claimed in claim 1, wherein the cylindrical bodies which are designed as running rollers have substantially half the diameter of said driving rollers.

4. A pull-out guide assembly as claimed in claim 2 wherein said running rollers are arranged in said supporting rails, and said driving rollers are arranged at opposite sides of said center rail.

5. A pull-out guide assembly as claimed in claim 1, in the inserted position of the drawer, two times two running rollers and one driving roller are arranged on a common vertical line on each side of the drawer.

6. A pull-out guide assembly as claimed in claim 1, wherein said supporting rail and said pull-out rail have identical profiles and are in respect of the profiles turned in respect of each other by 180°.

* * * * *